US005388348A

United States Patent [19]

Tanaka et al.

[11] Patent Number: 5,388,348

[45] Date of Patent: Feb. 14, 1995

[54] DRYING MACHINE AND METHOD WITH A PREDRYING OBJECT-SEPARATING FUNCTION

[75] Inventors: Miho Tanaka, Aichi; Kinya Hayashi, Gifu, both of Japan

[73] Assignee: Kabushiki Kaisha Toshiba, Kawasaki, Japan

[21] Appl. No.: 28,183

[22] Filed: Mar. 9, 1993

[30] Foreign Application Priority Data

Mar. 31, 1992 [JP] Japan ..... 4-077438

[51] Int. Cl.[6] ..... F26B 3/00; F26B 21/06

[52] U.S. Cl. ..... 34/499; 34/547; 34/549; 34/493; 34/543

[58] Field of Search ..... 34/52, 46, 44, 48, 55, 34/498, 499, 543, 546, 547, 549, 553, 554, 560, 572, 487, 493

[56] References Cited

U.S. PATENT DOCUMENTS 3,514,867 6/1970 Patrick ..... 34/52

FOREIGN PATENT DOCUMENTS 61-109598 5/1986 Japan .
1062258 3/1967 United Kingdom .
1490371 11/1977 United Kingdom .
2151861 7/1985 United Kingdom .

*Primary Examiner*—Denise L. Gromada
*Attorney, Agent, or Firm*—Cushman, Darby & Cushman

[57] ABSTRACT

A drying machine has a predrying operation. In the predrying operation before heated air is supplied to the drying chamber to dry clothes in the drying chamber, the drum repeats the rotation of the clockwise and counterclockwise alternately in a short cycle, so that entwined clothes are got loose. During the predrying operation, cool air is supplied to the drying chamber. Then the heated air is supplied to the drying chamber, so that clothes are dried.

14 Claims, 5 Drawing Sheets

| TEMP. [°C] | FIBER |
|---|---|
| 180 - 200 | COTTON, HEMP |
| 150 - 160 | VINYLON, WOOL |
| 140 - 150 | RAYON, CUPRO |
| 130 - 140 | SILK, POLYURETHANE |
| 120 - 130 | NYLON, POLYESTER |
| UNDER 120 | ACETATE, ACRYLIC FIBER |

DRYING MACHINE AND METHOD WITH A PREDRYING OBJECT-SEPARATING FUNCTION

BACKGROUND OF THE INVENTION

The present invention relates to a drying machine for drying objects of drying, clothes or the like, contained in a drying chamber.

A prior drying machine has a drum in which clothes are contained. The drum is rotated while heated air is supplied into the drum. This promotes the evaporation of water included in the clothes, so that the drying machine can dry clothes contained in the drum.

Generally speaking, after clothes are washed and dehydrated in a washing machine, clothes are put into the drum of the drying machine. The clothes are generally dehydrated by a high speed spinning, so they generally become entwined with each other. Therefore, most of clothes are put into the drum in the entwined condition. In clothes which are entwined, fibers are extended, twisted and bent in the drum. As a result, in the prior drying machine, heated air is supplied into the drum containing clothes, and sets these clothes by heat into a distorted condition. Then, since the clothes are ironed in a distorted condition, the clothes get out of shape and wrinkled.

Since clothes in the drum are collected easily on a lower portion within the drum, an inlet through which the heated air is supplied is located near the lower portion to dry clothes efficiently. But the temperature of the heated air supplied into the drum is about 120° C. as shown in FIG. 7, which promotes the above problem due to the high temperature of the heated air. Because the temperature of 120° C. is suitable for clothes being nylon or polyester, as shown in FIG. 8, which have a low melting point, to be ironed, especially the above clothes are easily set in out of shape by the heat.

SUMMARY OF THE INVENTION

It is an object of the present invention to provide a drying machine which can dry clothes, and can minimize getting out of shape of clothes and getting wrinkles of clothes.

In order to achieve the above object of the present invention, there is provided a drying machine having a drying operation, comprising:

a) a rotatable drum having a drying chamber therein which holds objects of drying;
b) heating means for heating air supplied to the drying chamber during the drying operation;
c) drive means for rotating the rotatable drum; and
d) control means for controlling the heating means and the drive means during a predrying operation which occurs before the drying operation, to turn off heating means and to rotate the drum clockwise and counterclockwise alternately.

The present invention also contemplates a method according to the above.

DESCRIPTION OF THE PREFERRED EMBODIMENT

An embodiment of the present invention will now be described as follows.

Figure 5:
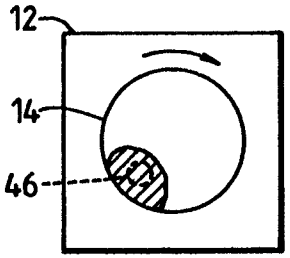
FIG. 5 is an illustrative diagram showing the drum of the drying machine rotating clockwise.
Figure 3:
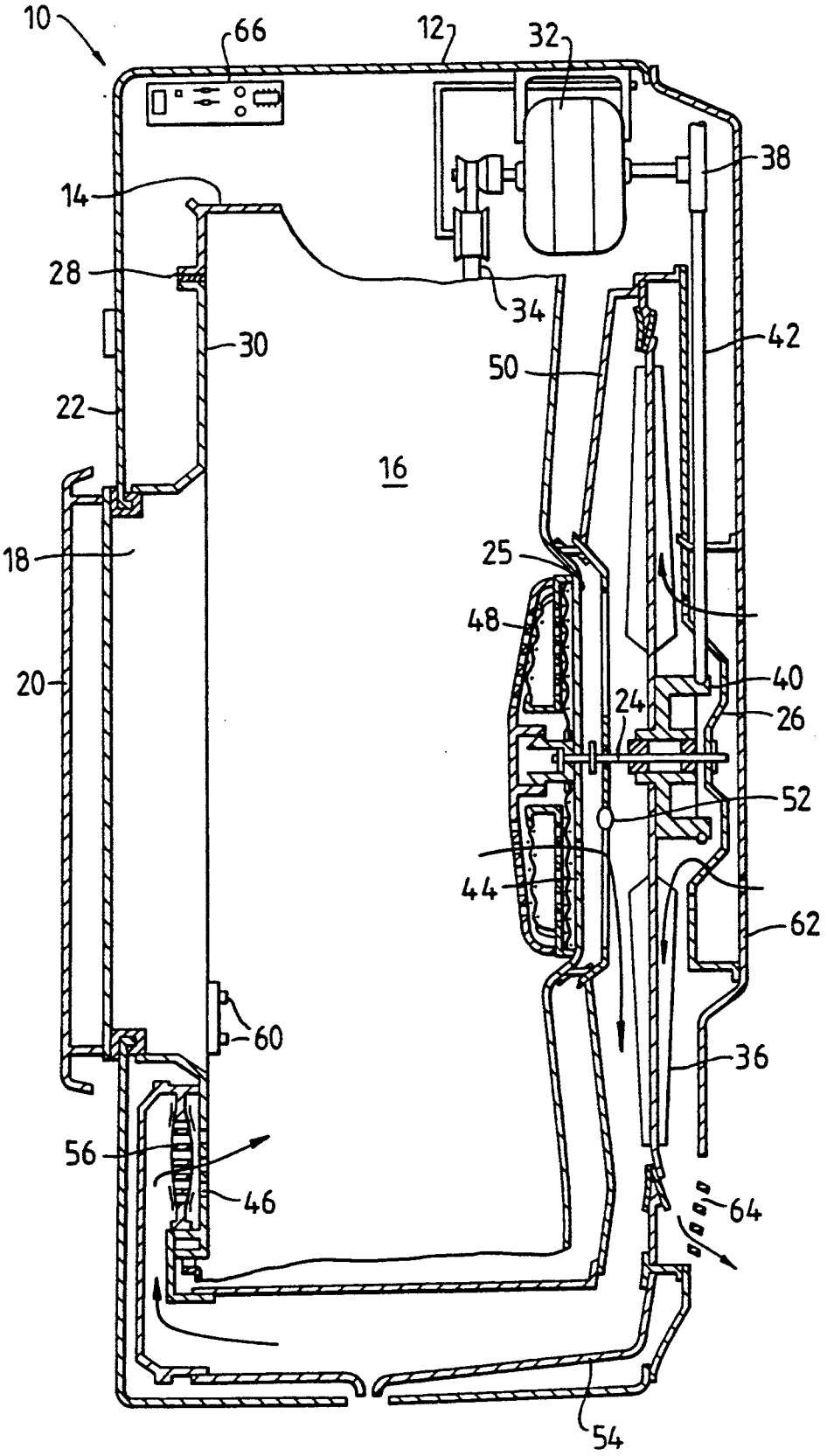
FIG. 3 is a view in vertical section of the entire drying machine including the embodiment of the present invention.

In FIG. 3, a drying machine 10 has an outer casing 12 and a rotatable drum 14 constituting a drying chamber 16 which is located in the outer casing 12. An opening 18 through which clothes are loaded and removed from the drying chamber 16 is formed in the middle front of the outer casing 12. A door 20 which opens and closes the opening 18 is pivotally mounted on a front face 22 of the outer casing 12. The drum 14, having an axis 24 provided on the axial center of the rear side 25 thereof, is rotatably supported by a rear plate 26 located near a near portion of the outer casing 12. A large opening 28, connected to the opening 18 and formed on the front side of the drum 14, is rotatably supported by an annular support plate 30 fixed on the front face 22. Within an upper portion of the outer casing 12 a motor 32 as drive means, which can be rotated clockwise and counterclockwise, is located outside of the drum 14. The drum 14 is rotated by the motor 32 through a belt 34. A rotating heat exchanger 36 of a double fin type as fan means is provided between the rear side 25 of the drum 14 and the rear plate 26, and is rotatably supported by the axis 24. The heat exchanger 36 is driven by the motor 32 through a pair of pulleys 38 and 40 and a fan belt 42. A plurality of outlets 44 are formed on the rear side 25 of the drum 14, and a inlet 46 having many small holes is formed shifting toward clockwise on the lower side within the annular support plate 30 (as shown in FIG. 5).

A filter 48 is located on the rear side 25 within the drum 14, which covers the outlets 44. A fan casing 50 is located on a rear portion of the rear side 25 of the drum 14. A thermistor 52 which forms one part of a temperature detecting circuit 53, is provided near the outlets 44 on the fan casing 50. A duct 54 is provided on the outside of the drum 14, which connects the outlets 44 and the inlet 46. A heater 56 is located near the inlet 46 in the duct 54. A pair of detection electrodes 60 are fixed to the support plate 30. The detection electrodes 60 face the inside of the drum 14 to contact the clothes put into the drum 14. Drawing holes 62 and drain holes 64 are formed in the rear portion of the outer casing 12. Outside air is forced from the drawing holes 62 through the heat exchanger 36 to the drain holes 64 and inside air is circulated through the drying chamber 16, the heat exchanger 36 and the duct 54 due to the rotation of the heat exchanger 36. As a result, in a drying operation when clothes are dried, since the heater 56 is turned on, heat is exchanged between the inside air and the outside air. In a predrying operation in advance of the drying operation, the heater 56 is turned off, so that the low temperature inside air is circulated through the drying chamber 16.

Figure 4:
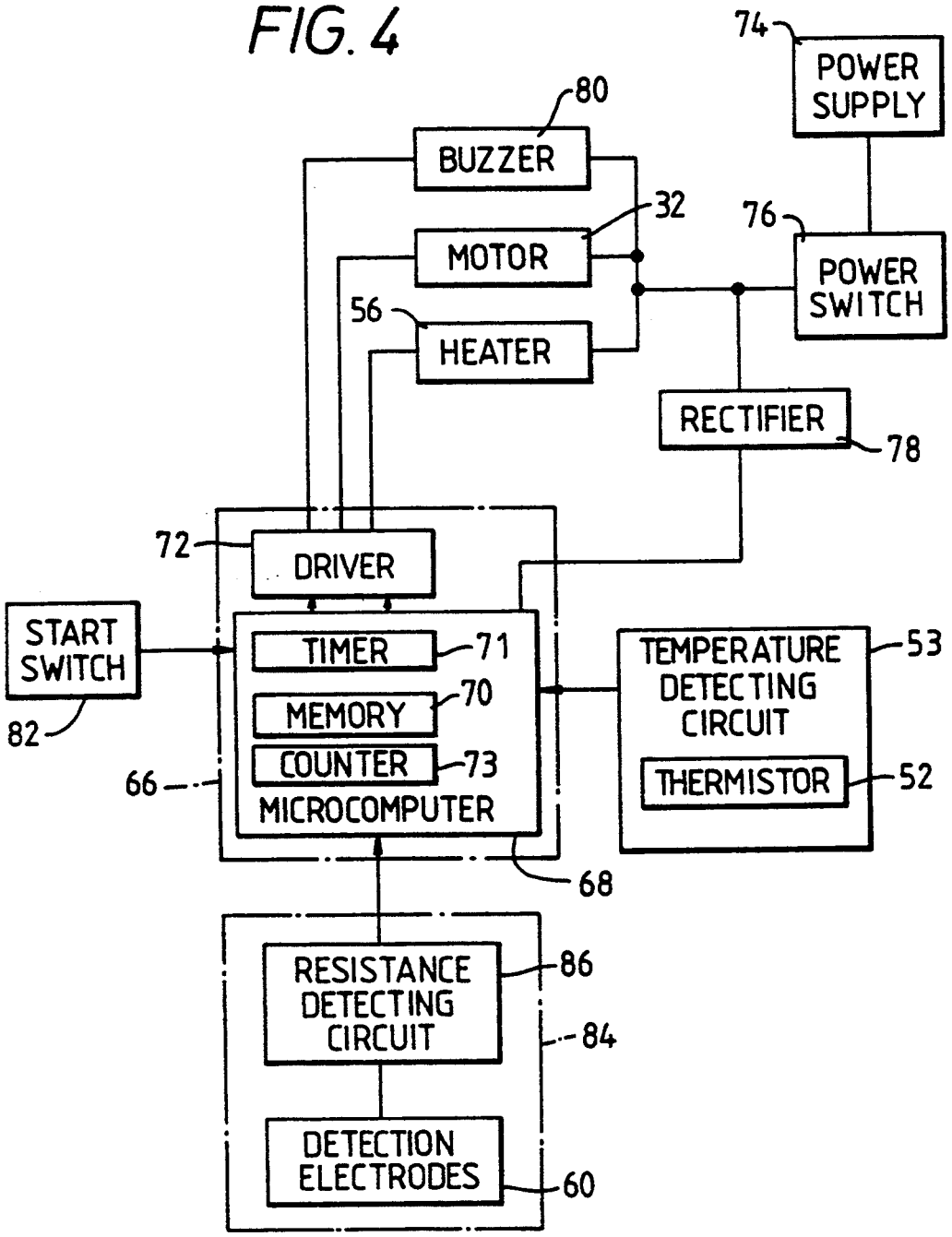
FIG. 4 is a block diagram showing an electrical arrangement of the drying machine including the embodiment of the present invention.
Figures 7, 8:
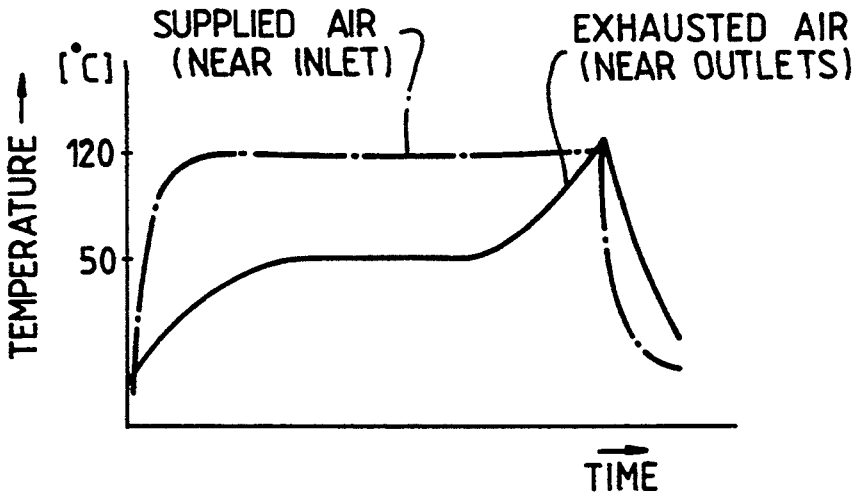
FIG. 7 is a graph showing the relationship between a temperature of air and a time for the drying operation.
FIG. 8 is a graph showing the suitable temperature to be ironed for kinds of fiber.

FIG. 4 shows a controller 66 which is used as control means. Controller 66 includes a microcomputer 68 having a memory 70 in which programs are stored, a timer 71 and a driver 72. A counter 73 counts a number of times that the direction of rotation of the drum 14 from clockwise to counterclockwise. AC power supply 74 is coupled to the microcomputer 68 through a power switch 76 and a rectifier 78. The AC power supply 74 is coupled in parallel to a buzzer 80, the motor 32 and the heater 56 through the power switch 76. The microcomputer 68 is coupled to the buzzer 80, the motor 32 and the heater 56 through the driver 72, to turn on and off the buzzer 80, the motor 32 and the heater 56 based on the output signal from the microcomputer 68.

The temperature detecting circuit 53 is coupled to the microcomputer 68. The microcomputer 68 determines the temperature of the inside air exhausted through the outlets 44 in accordance with the resistance of the thermistor 52. A start switch 82 is coupled to the microcomputer 68. When power switch 76 is on, and the start switch 82 is depressed, the program in the memory 70 is started. A degree-of-dryness detecting circuit 84 as a degree-of-dryness detecting means comprises the detection electrodes 60 and a resistance detecting circuit 86. The resistance detecting circuit 86 detects the resistance of clothes contacting between detection electrodes 60. The degree-of-dryness detection circuit 84 detects the degree of dryness in accordance with the resistance, and the data of the degree of dryness is output to the microcomputer 68.

The degree-of-dryness detecting circuit 84 is disclosed in U.S. Pat. No. 4,738,034 in detail. The contents of this patent are incorporated by reference.

A degree of dryness is defined as follows.

W1: weight of clothes in the states that clothes are held for one day in a room: Temperature is 20° C., Humidity is 65%

W2: actual weight of clothes

X: degree of dryness (%)

$X = W1/W2 \times 100$

Figure 1:
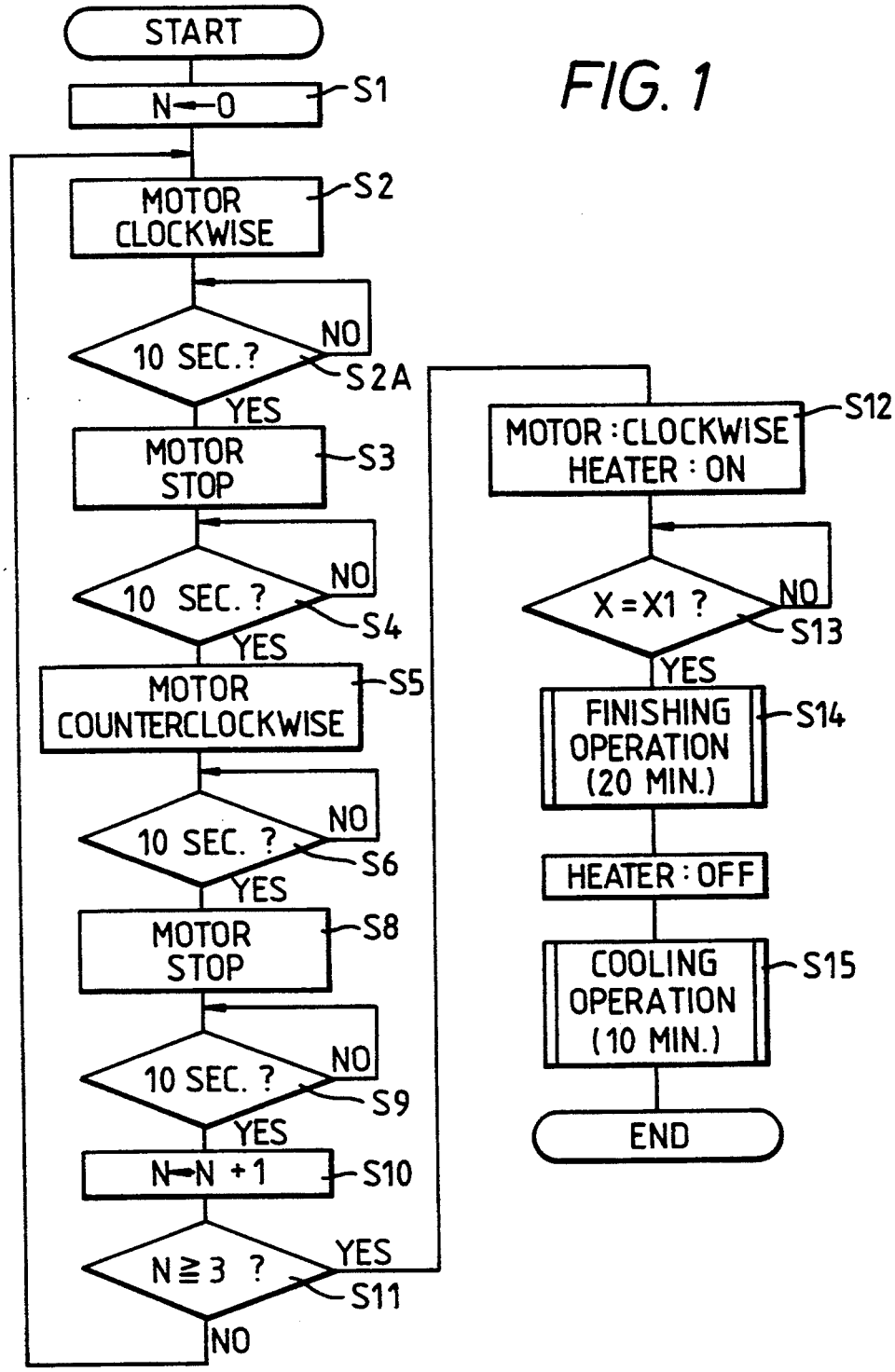
FIG. 1 is a flow chart showing a predrying operation, a drying operation and a cooling operation of the drying machine including an embodiment of the present invention.
Figure 2:
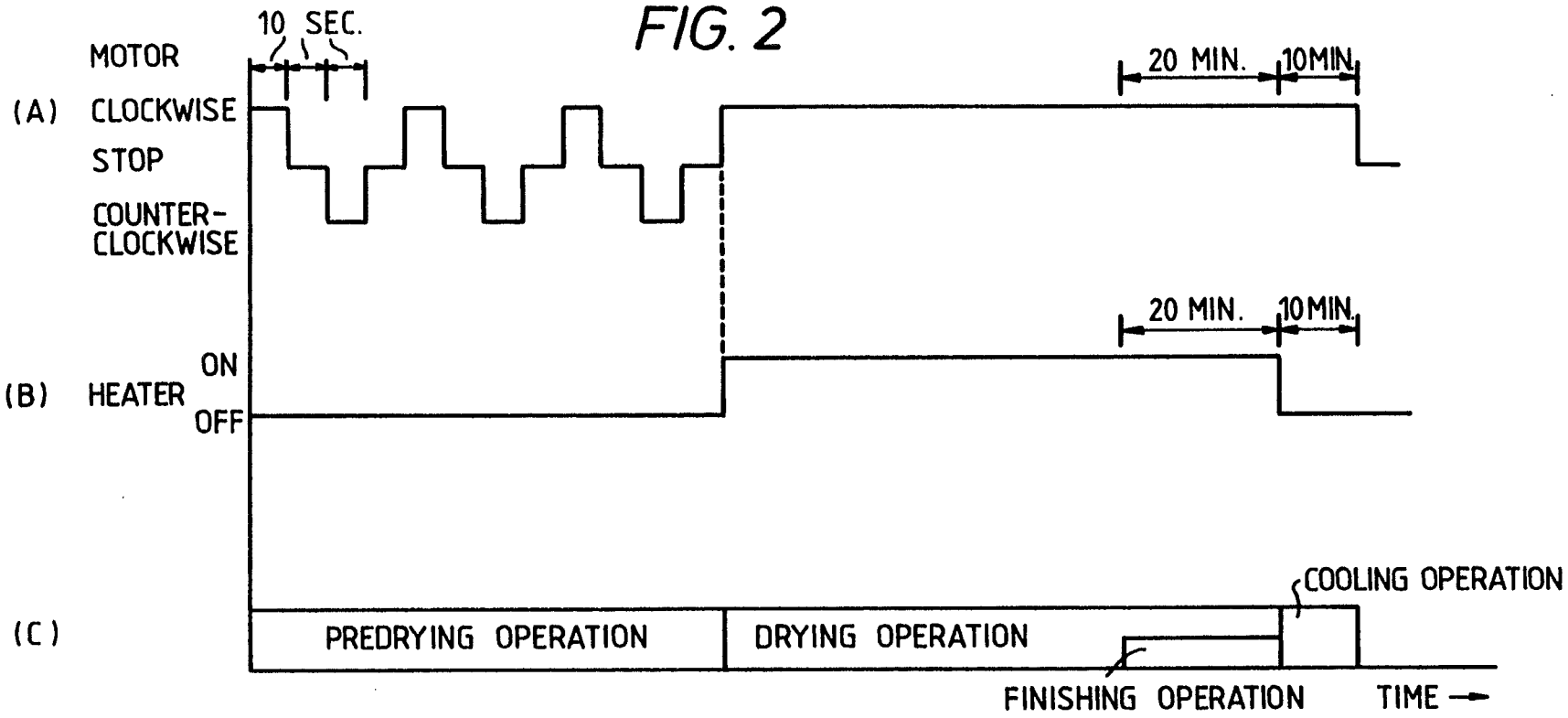
FIG. 2 is a timing chart in the predrying operation, the drying operation, and a cooling operation, (A) showing an operation signal for a motor output from a microcomputer, (B) showing an operation signal for a heater output from the microcomputer, (C) showing operation with time.

With reference to FIG. 1 and FIG. 2, an operation of the drying machine 10 based on the program in the microcomputer 68 will be described as follows.

The door 20 is opened, clothes are put into the drying chamber 16, and then the door 20 is closed.

When the power switch 76 is turned on, and the start switch 82 is depressed, the microcomputer 68 sets a setting N of the counter 73 to zero (step S1). The motor 32 is rotated clockwise based on an operation signal output from the microcomputer 68 (step 2). The drum 14 is also rotated clockwise due to the rotation of the motor 32. At the end of ten seconds (Steps 2A), power to the motor is stopped. Even though the operation signal to the motor 32 is stopped, the motor 32 continues to rotate for a while due to the inertia of the drum 14. After a time the motor 32 and the drum 14 are stopped. Though the heat exchanger 36 is also rotated clockwise due to the rotation of the motor 32, the heater 56 is turned off, so that cool air is supplied to the drying chamber 16.

Figure 6:
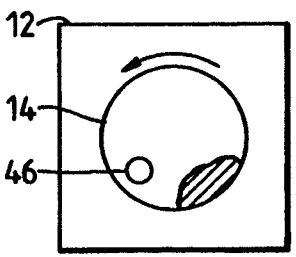
FIG. 6 is an illustrative diagram showing the drum of the drying machine rotating counterclockwise.

No electric current is supplied to the motor 32 for ten seconds after the operation signal for rotation of the motor 32 is stopped. This allows waiting until the drum 14 has stopped rotating due to the inertia of the drum 14. The whole cycle is again repeated in the reversed direction. Ten seconds after the initial power cut off (Step S4), the motor is rotated counter clockwise (Step S5). The electric current is supplied to the motor 32 for ten seconds so that the motor 32 is rotated counterclockwise (step S6 and S7). The drum 14 is rotated counterclockwise as well as the motor 32 as shown in FIG. 6. In that case, though the heat exchanger 36 is also rotated counterclockwise, since the heater 56 is turned off, cool air is supplied to the drying chamber 16 in the same way as when the motor 32 being rotated clockwise. Then, after ten seconds of counter clockwise motion, the electric current is not supplied to the motor 32 for ten seconds (step S8 and S9).

The microcomputer 68 adds one to the number N of the counter 73 (step S10). In a next step S11, the microcomputer 68 determines if the number is not less than three. When the number N is less than three, flow returns to the step S2. When the number N is not less than three, a predrying operation from the steps S1 to S11 is finished and a drying operation can be immediately performed.

Though clothes input to the drying chamber 16 at the beginning of the predrying operation, are entwined with each other, the charging the direction of the rotation of the drum 14 is repeated multiple times, to gradually loosen entwined clothes in the drying chamber 16.

In a beginning step S12 of the drying operation, the motor 32 is rotated clockwise and the heater 56 is turned on. In the drying operation, a signal of degree of dryness X of clothes is input to the microcomputer 68 from the electrodes 60 through the degree-of-dryness detecting circuit 84. The microcomputer 68 determines if the degree of dryness X has reached a predetermined degree of dryness X1, for example, 90 to 95% (step S13). Clothes are dried due to heating the air and rotating the drum 14 upon reaching the predetermined degree of dryness X1. In the step S13, when the degree of dryness X reaches the predetermined degree of dryness X1, the timer 71 is started. The heater 56 is turned on and the motor 32 is rotated clockwise continuously until time of the timer 71 becomes twenty minutes in the drying operation (step S12 to S14). This is called a finishing operation (step S14). After the finishing operation, a cooling operation (step S15) is started. In the cooling operation, the heater 56 is turned off, and the motor 32 is rotated clockwise continuously for ten minutes, so that the low temperature air is supplied to the drying chamber 16 to cool clothes in the drying chamber 16. Then, the motor 32 is stopped, and the cooling operation is finished.

According to the embodiment of the present invention, before the drying operation when the heated air is supplied to clothes, the drum 14 containing clothes is rotated clockwise and counterclockwise alternately in a short cycle without supplying the heated air, so that entwined clothes in the drying chamber 16 are loosened without heat.

Therefore, since the heated air is supplied to clothes being got loose in the drying operation, clothes are not set by heat in a distorted condition. As a result, clothes can be dried efficiently with minimizing getting out of shape and getting wrinkles.

Moreover, the inlet 46 is located shifted toward a direction of clockwise rotation on the lower side within the annular support plate 30 so that the inlet 46 faces clothes collected in the lower portion of the drying chamber 16. This increases the drying efficiency, and helps prevent clothes being set by heat in a distorted condition.

Further, in the predrying operation, since cool air is supplied also, clothes can be loosened easily.

Further, the number of changing the direction if the rotation can be set except three, the interval time between clockwise rotation and counterclockwise rotation is not always necessary.

The foregoing disclosure and drawings are merely illustrative of the principles of the present invention and not to be interpreted in a limiting sense. The only limitation is to be determined from the scope of the appended claims.

What is claimed is:

1. A drying machine having a drying operation, comprising:

a) a rotatable drum having a drying chamber therein which holds objects of drying;

b) heating means for heating air supplied to the drying chamber during the drying operation;

c) drive means for rotating the rotatable drum; and d) control means for controlling the heating means and drive means during a pre-drying operation which occurs before the drying operation, to turn off the heating means, and to rotate the drum clockwise and counterclockwise alternately.

2. A drying machine according to claim 1, wherein the control means controls the drive means so that the rotatable drum is rotated clockwise and counterclockwise alternately in a short cycle of a predetermined time.

3. A drying machine according to claim 1, further including an interval of non-rotation of the rotatable drum between each clockwise rotation and each counterclockwise rotation of the rotatable drum.

4. A drying machine according to claim 3, wherein the interval is long enough for an inertia of rotation of said rotatable drum to dissipate.

5. A drying machine according to claim 1, wherein the control means controls the drive means so that the rotatable drum is rotated clockwise and counterclockwise alternately for a predetermined number of times of changing the direction of the rotation of the rotatable drum.

6. A drying machine according to claim 1, wherein the control means controls the drive means so that the rotating drum is rotated in one direction in the drying operation.

7. A drying machine according to claim 1, further including fan means for supplying air to the drying chamber and an inlet faced to the drying chamber through which the air is supplied.

8. A drying machine according to claim 7, wherein the inlet faces a lower portion of the drying chamber.

9. A drying machine according to claim 8, wherein the inlet is shifted toward a direction of clockwise rotation the lower portion of the drying chamber.

10. A drying machine as in claim 1 wherein said control means includes means for de-energizing the drive means to stop a first rotation of the rotatable drum, and means for re-energizing the drive means to rotate the rotatable drum in an opposite direction to a direction of said first rotation, a counter for counting a number of times that a direction of rotation of the drum has been switched from one direction to another direction, and means for ending said pre-drying operation when a number counted by said counter coincides with a predetermined number.

11. A drying machine having a drying operation, comprising:

a) a rotatable drum constituting a drying chamber, having an outlet, for containing clothes or the like;

b) an inlet facing a lower portion of the drying chamber;

c) a duct connecting the inlet and the outlet;

d) heating means located in the duct for heating air supplied to the drying chamber;

e) drive means, having a motor, for rotating the rotatable drum;

f) fan means having a fan driven by the motor for exhausting air from the drying chamber through the outlet and for supplying the air through the inlet through the duct and for exchanging heat between the air and outside air; and g) control means for controlling the heating means so that the heating means is turned off and for controlling the drive means so that the rotating drum is rotated clockwise and counterclockwise alternately for a predetermined time and a predetermined number of times of changing the direction of the rotation of the rotating drum and for controlling the fan means so that the non-heated air is directly supplied to clothes collected in the lower portion of the drying chamber before the drying operation.

12. A method of operating a drying machine for drying clothes, the drying machine of the type including a rotatable drum having a drying chamber therein, heating means for heating air to the drying chamber, drive means for rotating the rotating drum, and control means for controlling the heating means and drive means, comprising the steps of:

turning off the heating means during a pre-drying operation which occurs before a drying operation and blowing unheated air into the drying chamber; and actuating the drive means during the pre-drying operation to alternately rotate the drum clockwise and counterclockwise.

13. A method as in claim 12 comprising the further steps of counting a number of times during which the drive means alternately changes from clockwise to counterclockwise, comparing said number of times against a predetermined threshold; and terminating the pre-drying operation when said number of times reaches the predetermined threshold.

14. A drying machine having a drying operation, comprising:

a) a rotatable drum having a drying chamber therein which holds objects of drying;

b) heating means for heating air supplied to the drying chamber during the drying operation;

c) drive means for rotating the rotatable drum;

d) control means for controlling the heating means and drive means during a pre-drying operation which occurs before the drying operation, to turn off the heating means, and to rotate the drum clockwise and counterclockwise alternately; and e) fan means for supplying air to the drying chamber including an inlet faced to the drying chamber through which the air is supplied, wherein the drive means includes a motor, and the fan means includes a fan driven by the motor, operating to supply non-heated air to the drying chamber due to the rotation of the fan while the rotating drum is rotated clockwise and counterclockwise alternately without actuation of the heating means.

* * * * *